US006904243B2

(12) United States Patent
Smith et al.

(10) Patent No.: US 6,904,243 B2
(45) Date of Patent: Jun. 7, 2005

(54) IMAGE FORMING SYSTEM AND METHOD AND PHOTOCONDUCTOR HAVING WEAR INDICATOR

(75) Inventors: Brett A. Smith, Boise, ID (US); Andrew P. Alegria, Nampa, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 107 days.

(21) Appl. No.: 10/164,532

(22) Filed: Jun. 7, 2002

(65) Prior Publication Data

US 2003/0228158 A1 Dec. 11, 2003

(51) Int. Cl.[7] ..... G03G 15/00
(52) U.S. Cl. ..... 399/26; 399/159; 430/56
(58) Field of Search ..... 399/26, 159; 430/56, 430/58.7

(56) References Cited

U.S. PATENT DOCUMENTS

| | | | | |
|---|---|---|---|---|
| 4,265,991 A | | 5/1981 | Hirai et al. | |
| 5,428,437 A | * | 6/1995 | Carter et al. | 399/26 X |
| 5,815,776 A | | 9/1998 | Nukada | |
| 5,822,646 A | * | 10/1998 | Kinoshita et al. | 399/26 X |
| 6,108,499 A | * | 8/2000 | Cernusak | 399/26 |
| 6,122,467 A | | 9/2000 | Ehara et al. | |
| 6,322,943 B1 | | 11/2001 | Aoki et al. | |
| 6,326,112 B1 | * | 12/2001 | Tamura et al. | 399/159 X |
| 6,345,158 B1 | * | 2/2002 | Oono | 399/26 X |
| 6,365,308 B1 | | 4/2002 | Kojima et al. | |
| 6,366,752 B1 | | 4/2002 | Weber | |

FOREIGN PATENT DOCUMENTS

| | | |
|---|---|---|
| JP | 55-029845 | * 3/1980 |
| JP | 55-129354 | * 10/1980 |
| JP | 55-133053 | * 10/1980 |
| JP | 55-134859 | * 10/1980 |
| JP | 9-054468 | * 2/1997 |

* cited by examiner

*Primary Examiner*—Fred Braun

(57) ABSTRACT

Systems, methods, and other embodiments associated with imaging systems and wear indicators are provided. In one example system, an imaging device is provided that generates and transfers an image to a print media. A photoconductor includes a photosensitive surface layer and a wear indicator layer under the surface layer. The wear indicator layer is visually distinct from the surface layer so that when the wear indicator layer is exposed, it indicates worn areas of the surface layer.

19 Claims, 3 Drawing Sheets

IMAGE FORMING SYSTEM AND METHOD AND PHOTOCONDUCTOR HAVING WEAR INDICATOR

FIELD OF THE INVENTION

The invention relates to the electrophotographic imaging arts. It finds particular application to an image forming system and photoconductor that includes a wear indicator. It will be appreciated that the present invention will find application in printers, copiers, facsimile machines or other imaging devices that include a photosensitive device for forming images.

BACKGROUND OF THE INVENTION

In electrophotographic imaging devices, electrostatic latent images are formed on photosensitive devices such as a organic photoconductor drum. These drums may include one or more layers of materials which include at least a surface layer of photosensitive material. The surface layer is selectively charged and discharged to form electrostatic latent images thereon. Toner is then magnetically attracted to the latent image and transfer to a print media.

Over time, the photosensitive material, which is relatively thin, will wear through at various areas. As worn areas lose the photosensitive material, the charging characteristics of the drum change which may alter its imaging quality. In prior art drums, worn areas of the drum are not easily identifiable making it difficult to determine the cause of poor image quality or potential defects in the photosensitive layer.

The present invention provides a new and useful photoconductor and imaging device that addresses the above problems and others.

SUMMARY OF THE INVENTION

In accordance with one embodiment of the present invention, an electrophotographic photoconductor is provided that includes a substrate and a first photoconductive layer disposed on the substrate, the first photoconductive layer having a first color. A second photoconductive layer is disposed over the first photoconductive layer and the second photoconductive layer has a second color distinct from the first color.

In accordance with another embodiment of the present invention, a replaceable cartridge for an image forming device is provided. The cartridge includes a toner reservoir for containing toner; a light sensitive device for forming an electrostatic latent image where the light sensitive device includes a surface layer of photosensitive material and an intermediate layer of photosensitive material under the surface layer. The intermediate layer is visually distinct from the surface layer where the intermediate layer indicates worn portions of the surface layer when the intermediate layer is visible. A developer roller applies toner from the toner reservoir to the light sensitive device.

One advantage of the present invention is that an early warning mechanism is provided that can alert a user when portions of a photosensitive device becomes worn.

Still further advantages of the present invention will become apparent to those of ordinary skill in the art upon reading and understanding the following detailed description of the illustrated embodiments.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of this invention.

DETAILED DESCRIPTION OF ILLUSTRATED EMBODIMENT

The following includes definitions of exemplary terms used throughout the disclosure. Both singular and plural forms of all terms fall within each meaning:

"Image", as used herein, includes but is not limited to any form of data representing an image that is to be generated and/or transferred to a print media during a printing process. Image includes any type of printable or printed markings such as characters, text, graphics or any combination of these.

"Imaging device", as used herein, includes but is not limited to electrophotographic printers, laser printers, facsimile machines, copiers, and other types of imaging devices that convert data to visible markings.

The present system provides an early warning mechanism to indicate wear on a photosensitive element, such as an organic photoconductor drum. Generally describing the configuration, a photoconductor drum or other type of photosensitive device includes at least two layers of differently colored photosensitive material. As portions of the surface layer wear through, the color of the second layer becomes visible. This identifies worn areas of the surface layer and identifies wear patterns that may assist troubleshooting. The photosensitive element may be embodied in an imaging device, or in a replaceable cartridge as will be described below.

Figure 1:
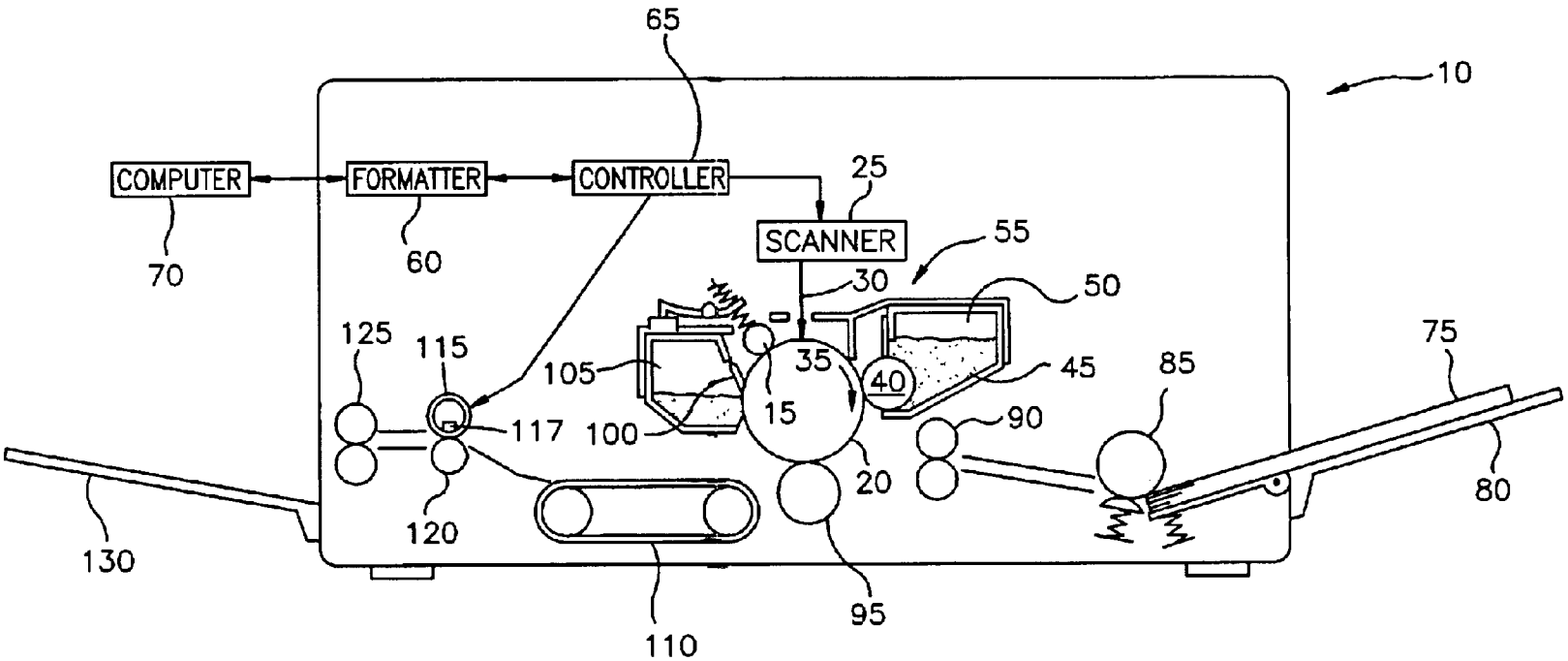
FIG. 1 is an exemplary simplified system diagram of an imaging device in accordance with one embodiment of the present invention.

Illustrated in FIG. 1 is a simplified cross sectional view of an exemplary electrophotographic imaging device, such as an electrophotographic printer 10, in accordance with one embodiment of the present invention. Exemplary components of the printer and its general operation will be discussed with reference to FIG. 1. The printer includes, for example, a charge roller 15 that charges the surface of a photoconductor, such as an organic photoconductor drum 20, to a predetermined voltage. The surface of the drum 20 includes a layer of photosensitive material that can be selectively charged and discharged. A laser scanner 25 includes a laser diode (not shown) that emits a laser beam 30 onto the photoconductor drum 20 to selectively discharge its surface. The laser beam is reflected off a multifaceted spinning mirror (not shown) that reflects or "scans" the beam across the surface of the photoconductor drum 20 forming a latent electrostatic image corresponding to the data being printed. The photoconductor drum 20 rotates in a clockwise direction as shown by the arrow 35 such that each successive scan of the laser beam is recorded on the drum 20 after the previous scan.

To this end, the electrophotographic imaging device 10 may include a software configured processing device, such as formatter 60 and controller 65. Alternatively, the electrophotographic printer 10 could use other processing devices such as a microprocessor, discrete logic or other digital state machines. To form a latent electrostatic image, the formatter 60 receives data, including print data (such as, a display list, vector graphics, or raster print data) from an application program running on a computer 70. The formatter 60 converts the print data into a stream of binary print data that is an electronic representation of each page to be printed, and sends it to the controller 65. The controller 65 supplies the stream of binary print data to the laser scanner 25 causing the laser diode to pulse in accordance with the data, thus creating the latent electrostatic image on photoconductor drum 20. In addition, the formatter 60 and controller 65 exchange data necessary for controlling the electrophotographic printing process as known in the art for a particular imaging device.

Figure 2:
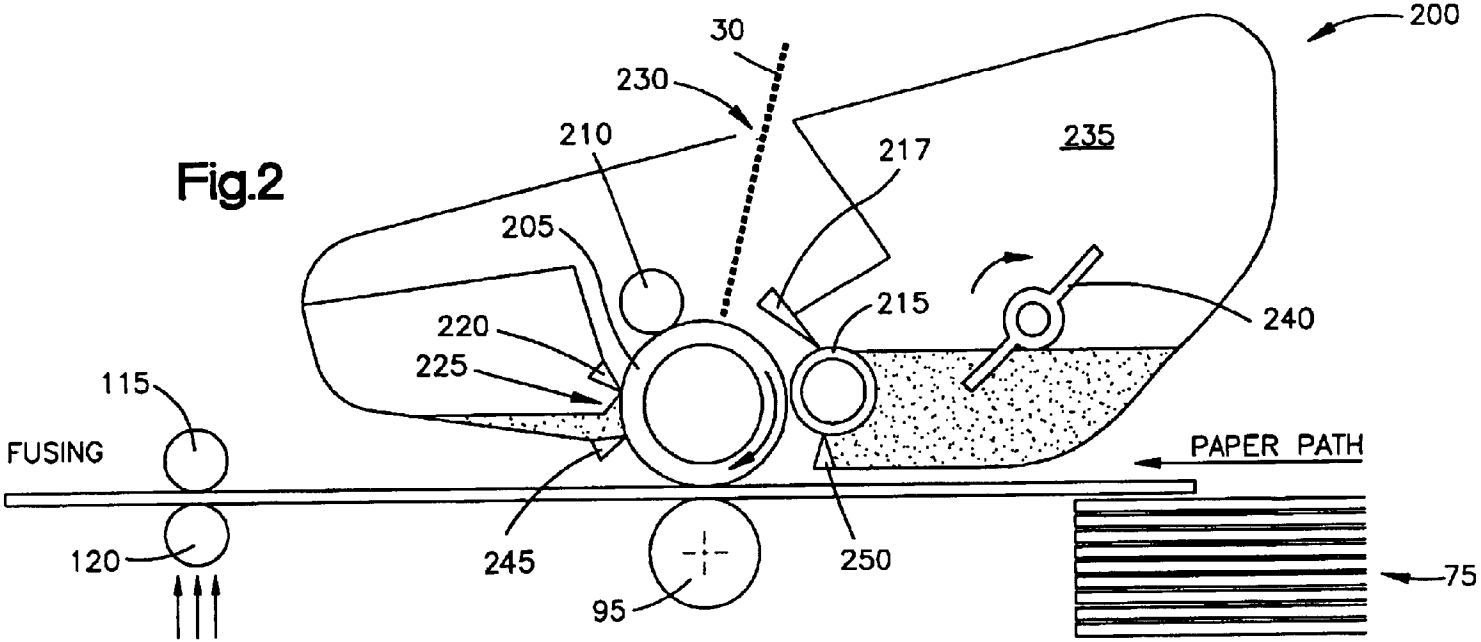
FIG. 2 is an exemplary replaceable cartridge in accordance with one embodiment of the present invention.

With further reference to FIG. 1, after the surface voltage of the drum 20 has been selectively discharged, a developing device, such as a developing roller 40, transfers toner to the surface of the drum 20. Toner 45, for example, is stored in a toner reservoir 50 of a toner print cartridge 55. The cartridge 55 may be detachable to replace consumed toner, worn parts, or both. Based on a desired configuration the cartridge 55 may include one or more replaceable components ranging from toner to an image forming system including, for example, the charger roller 15, the drum 20, the developing roller 40 and other associated parts. Another embodiment of a replaceable cartridge is shown in FIG. 2.

With continued reference to FIG. 1, the developing roller 40 is magnetized, for example, by a magnet (not shown) so that it magnetically attracts the toner 45 to the surface of the developing roller. As the developing roller 40 rotates, the toner is electrostatically transferred from the developing roller to the discharged surface areas on the photoconductor drum 20 thus covering the latent electrostatic image with toner particles.

A print media 75, such as paper, envelops, transparencies, etc., is loaded from a media tray 80 by a pickup roller 85 and travels in a printing path in the electrophotographic printer 10. The print media 75 moves through drive rollers 90 so that the arrival of the leading edge of the print media 75 at a transfer point below the photoconductor drum 20 is synchronized with the rotation of the latent electrostatic image on the drum 20. There, an image transfer device, such as a transfer roller 95, charges the print media so that it attracts the toner particles away from the surface of the photoconductor drum 20. As the drum 20 rotates, the toner adhered to the discharged areas contacts the charged print media 75 and is transferred thereto.

The transfer of toner particles from the drum 20 to the surface of the print media 75 is not always complete and some toner particles may remain on the drum 20. To clean the drum 20, a cleaning blade 100 may be included to remove non-transferred toner particles as the drum continues to rotate and the toner particles are deposited in a toner waste hopper 105. The drum may then be completely discharged by discharge lamps (not shown) before a uniform charge is restored to the drum 20 by the charging roller 15 in preparation for the next image generation and toner transfer.

As the cleaning blade 100 contacts and cleans the surface of the photoconductor drum 20, the contact causes frictional wear which, over time, removes portions of the photosensitive surface of the drum 20. As the thickness of the photosensitive surface decreases, the drum 20 may lose some of its charging characteristics which may affect the quality of printed images. As a warning mechanism, the drum 20 includes a second photosensitive layer under the surface layer that is visibly distinct from the surface layer. When portions of the surface layer wear through, the second layer will be visible which serves as a visual indicator that the photoconductor drum 20 should be replaced. Since the second layer is also photosensitive, the charging characteristics of the drum 20 can be substantially maintained without causing serious defects in print quality, thus, allowing some time for a user to replace the drum 20 individually, or if part of a replaceable cartridge, by replacing the cartridge 55. The dual photosensitive layers are further discussed with reference to FIG. 3.

Continuing with the printing example, as the print media 75 moves in the printing path past the photoconductor drum 20 and the transfer roller 95, it enters a post transfer area. There, a conveyer 110 delivers the print media 75 to a fixing device, such as a heated fuser roller 115 and a heated pressure roller 120, generally referred to herein as a fuser. The rollers are in pressure engagement with each other and form a nip at the contact point. As the media passes between the rollers through the nip, the toner is fused to the media through a process of heat and pressure. One or both rollers are motor driven to advance the media 75 between them. In one embodiment, the fuser is an on-demand fuser and the fuser roller 115 includes, for example, a flexible rotating sleeve that surrounds a carrier which holds a ceramic heating device 117. The carrier provides structure to the fuser roller so that pressure may be applied against the pressure roller 120. The flexible sleeve is typically made of polyimide. Alternately, the fuser can be a hard roller constructed with a hollow metal core and an outer layer often made of a hard "release" material such as a Teflon® film.

The heating device 117, such as a ceramic heating strip, is positioned inside the fuser roller 115 and along its length. The heating strip can be silver based with a glass cover to reduce friction with the fuser roller film 115. Other heating devices may include a quartz lamp, heating wires or other suitable heating element as known in the art. The pressure roller 120 is, for example, constructed with a metal core and a pliable outer layer. The pressure roller may also include a thin Teflon® release layer (not shown). After fusing the toner to the print media, output rollers 125 push the print media into an output tray 130 and printing is complete.

With continued reference to FIG. 1, the controller 65 also controls a high voltage power supply (not shown) to supply voltages and currents to components used in the electrophotographic processes, such as to the charge roller 15, the developing roller 40, the transfer roller 95 and fuser. Furthermore, controller 65 controls a drive motor (not shown) that provides power to a gear train (not shown) and controls various clutches and paper feed rollers that move the print media through the printing path within the electrophotographic printer 10. It will be appreciated that different imaging devices may have components and control mechanisms different than those shown in the exemplary system of FIG. 1. One of ordinary skill will appreciate that the present invention will apply to other devices in accordance with their particular configuration and obvious modifications thereto.

Illustrated in FIG. 2 is another embodiment of a replaceable cartridge 200 in accordance with the present invention. The cartridge 200 includes a housing that contains a photoconductive drum 205, a charge roller 210, a magnetic developer roller 215, a toner doctor blade 217 for cleaning the roller 215, a cleaning blade 220 for cleaning the drum 205, and a toner waste hopper 225 which operate as described above with reference to FIG. 1. As will be described in greater detail below, as the photosensitive layer of the drum 205 wears away through repeated use and engagement with the cleaning blade 220, portions of the drum 205 that are worn will change in color. The color change visually indicates to a user that the drum, or in this embodiment, the cartridge 200 should be replaced. To create the color change, the drum 200 includes at least two photosensitive layers, one being the top surface and the other being under it and having a different color than the top surface.

With further reference to FIG. 2, when the cartridge 200 is installed into an imaging device, the photoconductor drum 205 will be adjacent to a transfer roller 95 such that print media 75 passes between them and toner on the drum 205 transfers to the print media. Furthermore, the cartridge 200 will be aligned such that a laser window 230 formed through the housing allows a laser 30 to illuminate and discharge the drum 205.

The photoconductive drum 205 also includes a spline gear drive interface (not shown) that engages a gear drive of the imaging device to control rotation of the drum 205. In this embodiment, the cartridge 200 also includes one or more toner reservoirs 235 that contain toner, and a toner stirring blade 240 that rotates to push toner out of the toner reservoir to deliver the toner to the developer roller 215. Other components may include a toner recovery blade 245 that reduces waste toner from leaking out of the cartridge and a developer sealing blade 250 also to reduce toner leaks.

Figure 3:
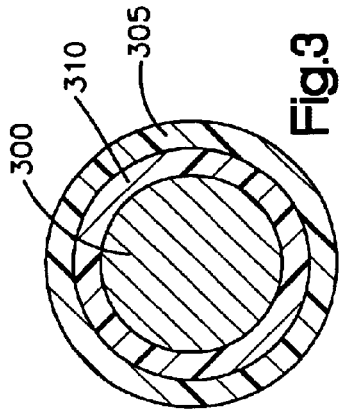
FIG. 3 is an exemplary cross-section of a photoconductor drum in accordance with one embodiment of the present invention.
Figure 4:
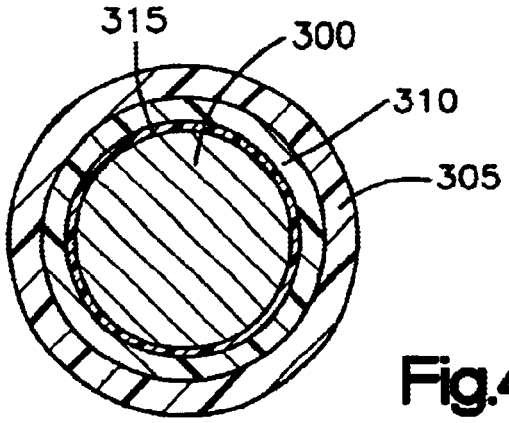
FIG. 4 is a cross-section of an example photoconductor drum having a plurality of layers.

With reference to FIG. 3, one embodiment of a photoconductive drum 300 having a wear indicator mechanism is shown that can be used in the systems of FIG. 1 and/or FIG. 2. The drum 300 is typically a cylindrical aluminum drum that includes a top surface layer 305 of photosensitive material. An intermediate indicator layer 310 of photosensitive material is disposed under the top layer 305 and acts as a wear indicator that is visually distinguishable when portions of the top layer 305 deteriorate over time. In one embodiment, the top layer 305 and indicator layer 310 have different colors so they are distinguishable by a user. As seen in example, FIG. 4, it will be appreciated that additional layers 315 can be added to the drum 300 to obtain desired properties.

In one embodiment, the top layer 305 and the indicator layer 310 are formed from the same material so that they have the same properties and charging characteristics except for their color. In this manner, once portions of the top layer 305 wear away, imaging quality will be minimally affected for the time being because the indicator layer 310 will maintain the charging characteristics of the drum 300 in the worn portions. Once the indicator layer 310 is visible, this is an early warning to a user that the cartridge and/or drum should be replaced.

By observing the photoconductor drum 300, color changes caused by excess wear will indicate which areas are effected. This may assist technicians when diagnosing problems with an imaging device. For example, if an imaging device is frequently used to print envelops or otherwise small print media, this can be determined by the color changes on the drum. When printing small media, the drum does not get toner applied over its entire surface and those areas that do not receive toner will show wear much sooner than areas that receive toner. This is because toner acts as a lubricant on the drum. Thus, when the drum gets cleaned by the cleaning blade, the no-toner areas will be subjected to more frictional engagement causing premature deterioration of the photosensitive layer. This situation can be easily determined from the visual indication of the exposed areas of the indicator layer 310.

In another embodiment, the top layer 305 and indicator layer 310 may be formed with different photosensitive materials. For example, in certain applications, one of the layers may be desired to be harder and more resistant to wear than the other layer.

Various materials can be used as the photosensitive layers such as selenium, cadmium sulfide, zinc oxide, phthalocyanine, amorphous silicon (hereinafter abbreviated as a-Si), etc. Among these materials, non-single-crystal deposited films containing silicon atoms as the main component, as represented by a-Si, for example amorphous deposited films such as a-Si compensated with hydrogen and/or halogen (for example fluorine or chlorine), may be used to form a photosensitive member having high performance and high durability properties, but with little or no ecological concerns. For example, U.S. Pat. No. 4,265,991 and U.S. Pat. No. 6,365,308 B2 disclose examples of electrophotographic photosensitive members and their compositions, which are incorporated herein by reference.

It will be appreciated that the layers 305, 310 can be made with the same thickness or different thicknesses. Also, it is contemplated that additional layers may be added to the drum 300 so that the top layer 305 and indicated layer 310 are not necessarily the first and second surface layers. For example, an intermediate layer may be added to the surface of either layer or in between the layers to add a desired property, but which will not significantly affect the charging characteristics of the photosensitive materials.

In its simplest embodiment, a method of manufacturing a photoconductive drum includes providing a metallic drum, applying an indicator layer of photosensitive material, and applying a surface layer of photosensitive material where the indicator layer and the surface layer have different distinguishable colors.

Figure 5:
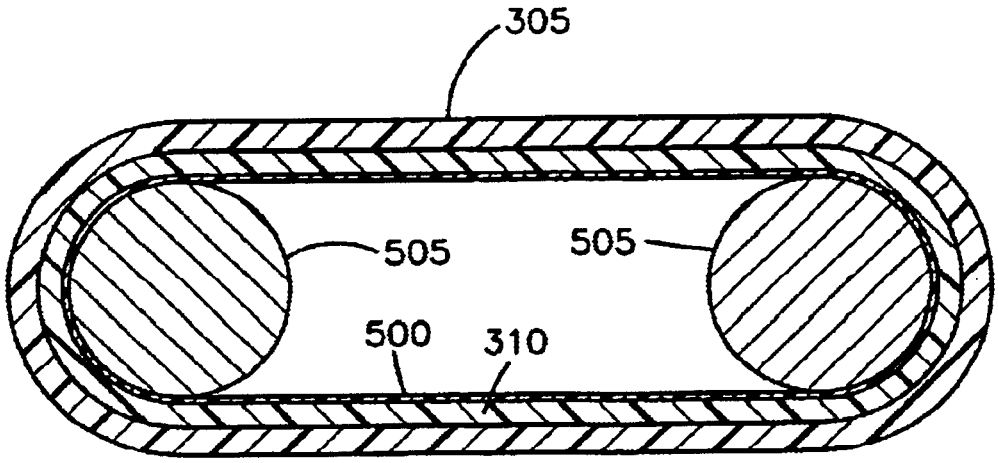
FIG. 5 is a cross-section of an example flexible band photoconductor.

With reference to FIG. 5, in another embodiment, the cylindrical photoconductor drum may be embodied as a flexible band 500 that can be rotated by one or more rollers 505. In general, the drum or band 500 is a substrate used to support one or more photosensitive layers (e.g. layers 305, 310). In another embodiment, the wear indicator layer may be formed of a non-photosensitive material having a different color than the photosensitive surface layer. In this configuration, print quality may be affected much sooner as the photosensitive layer diminishes.

With the present invention, an early warning mechanism is provided to indicate excess wear of a photoconductor drum. Since the indicator layer is also photosensitive, a user may continue printing operations for a limited time even when the surface layer begins to wear through.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. An electrophotographic photoconductor comprising:

a substrate;

a first photoconductive layer disposed on the substrate, the first photoconductive layer having a first color; and a second photoconductive layer disposed over the first photoconductive layer, the second photoconductive layer having a second color distinct from the first color where the first and second photoconductive layers have similar charging characteristics and, as portions of the second photoconductive layer decrease in thickness, the first color becomes visible.

2. The electrophotographic photoconductor as set forth in claim 1 wherein the substrate has a cylindrical drum shape.

3. The electrophotographic photoconductor as set forth in claim 1 wherein the substrate is a flexible band.

4. The electrophotographic photoconductor as set forth in claim 1 wherein the first and second photoconductive layers include silicon or a silicon compound.

5. The electrophotographic photoconductor as set forth in claim 1 further including three or more layers formed on the substrate.

6. A replaceable cartridge for an image forming device, the cartridge comprising:

a toner reservoir for containing toner;

a light sensitive device for forming an electrostatic latent image, the light sensitive device including a surface layer of photosensitive material and an intermediate layer of photosensitive material under the surface layer;

the intermediate layer being visually distinct from the surface layer where the intermediate layer indicates worn portions of the surface layer when the intermediate layer is visible; and a developer roller for applying toner from the toner reservoir to the light sensitive device.

7. The replaceable cartridge as set forth in claim 6 further including a charge roller for charging the light sensitive device to a predetermined charge.

8. The replaceable cartridge as set forth in claim 6 wherein the light sensitive device includes a metallic substrate supporting the surface layer and the intermediate layer.

9. The replaceable cartridge as set forth in claim 6 wherein the light sensitive device is an organic photoconductor drum.

10. The replaceable cartridge as set forth in claim 6 wherein the light sensitive device includes a flexible band substrate that supports the surface layer and intermediate layer.

11. The replaceable cartridge as set forth in claim 6 wherein the surface layer includes a first color and the intermediate layer includes a second color different from the first color.

12. The replaceable cartridge as set forth in claim 6 wherein the surface layer and the intermediate layer are formed of substantially identical photosensitive materials.

13. The replaceable cartridge as set forth in claim 6 wherein the surface layer and the intermediate layer include silicon or a silicon compound.

14. An imaging device comprising:

a photoconductor that generates an electrostatic latent image, the photoconductor having a photosensitive surface layer;

a developer roller for applying toner to the electrostatic latent image;

a transfer roller for transferring the toner from the photoconductor to a print media;

a fuser that fuses the image to the print media; and a wear indicator being formed as a layer under the photosensitive surface layer on the photoconductor, the wear indicator is a layer of photosensitive material and being visually distinct from the photosensitive surface layer so that when areas of the photosensitive layer diminish in thickness, the wear indicator becomes visible to indicate the diminished areas.

15. The imaging device as set forth in claim 14 wherein the photoconductor is removable and replaceable.

16. The imaging device as set forth in claim 14 wherein the photoconductor and developer roller are embodied in a replaceable cartridge.

17. The imaging device as set forth in claim 16 wherein the replaceable cartridge further includes:

a toner reservoir for containing toner that is supplied to the developer roller; and a toner waste hopper for collecting toner from the photoconductor.

18. The imaging device as set forth in claim 14 wherein the wear indicator has equivalent charging characteristics as the photosensitive surface layer.

19. A method of manufacturing a photoconductive drum comprising the steps of:

providing a substrate;

applying an indicator layer of photosensitive material over the substrate; and applying a surface layer of photosensitive material over the indicator layer where the indicator layer and the surface layer have different distinguishable colors.

* * * * *